United States Patent [19]

Bodine

[11] 4,271,915

[45] Jun. 9, 1981

[54] ELASTICALLY VIBRATORY LONGITUDINAL JACKETED DRILL

[76] Inventor: Albert G. Bodine, 7877 Woodley Ave., Van Nuys, Calif. 91406

[21] Appl. No.: 63,840

[22] Filed: Aug. 6, 1979

[51] Int. Cl.[3] ..... E21B 4/02

[52] U.S. Cl. ..... 175/56; 175/105; 418/48

[58] Field of Search ..... 175/107, 55, 56; 418/48; 366/120, 124

[56] References Cited

U.S. PATENT DOCUMENTS

| | | | |
|---|---|---|---|
| 2,743,083 | 4/1956 | Zublin | 175/56 |
| 2,903,242 | 9/1959 | Bodine | 175/55 |
| 3,096,833 | 7/1963 | Bodine | 175/56 |
| 3,603,407 | 9/1971 | Clark | 418/48 |
| 3,746,310 | 7/1973 | Fransson et al. | 418/48 X |

*Primary Examiner*—William F. Pate, III
*Attorney, Agent, or Firm*—Edward A. Sokolski

[57] ABSTRACT

A drill bit is connected to the bottom end of a longitudinally elastic drill stem which is contained within a jacket. An orbiting mass oscillator is coupled to the drill stem, this oscillator generating vibrational energy at a sonic frequency. The rotation axis of the oscillator is parallel to the drill stem, the drill stem being driven elastically, preferably at a frequency such as to set up standing waves therein, whereby circumferentially successive lengthwise oriented regions around the periphery of the column cyclically elongate and contract longitudinally in rotary progression. This longidudinal vibratory energy is transferred to the drill bit causing nutation thereof such that successive portions of the bit drive into the work material in a progression of longitudinal impulses as the stem undergoes circumferentially successive longitudinal cyclic motion in response to the vibratory energy applied thereto. This motion is limited by a jacket which surrounds the stem, thus effectively limiting the cyclic stress of this stem and isolating the vibrations thereof from the supporting structure of the assembly.

18 Claims, 21 Drawing Figures

ELASTICALLY VIBRATORY LONGITUDINAL JACKETED DRILL

This invention relates to drills suitable particularly for drilling hard material, such as rock, masonry, or concrete, and more particularly to such a device employing a longitudinally elastic drill stem which drives the drill bit in a vibratory nutating fashion in response to sonic vibratory energy.

In the drilling of hard material such as rock, concrete, masonry, etc., in mining operations, well drilling and construction work, considerable energy is needed to effectively accomplish the drilling. Further, the drill bits often overheat and become damaged in view of the hardness of the work material involved. Thus, considerable attention has been given to either finding improved bits or providing improved techniques and apparatus for increasing the efficiency of their operation. One technique that has met with considerable success is the use of sonic vibratory energy, generated by means of an orbiting mass oscillator, for driving the drill bit. A particulaly effective technique along these lines involves the setting up of longitudinal standing wave resonant operation of the drill stem which greatly enhances the efficiency of the generation of the sonic energy employed. Such apparatus and techniques are described in numerous of my prior patents including, for example, my U.S. Pat. Nos. 2,554,005; 2,717,763; 2,942,849; 3,139,146; 3,163,240; and 3,211,243.

The device of the present invention is an improvement over such prior art sonic drilling devices in that an improved drilling action is achieved by causing the drill bit to nutate at the sonic vibration frequency, thus causing successive portions of the bit's contacting surface or teeth to impact longitudinally against the work material. This provides a very effective longitudinal vibratory drilling action with strong cyclic force being applied against highly localized regions of the rock which are successively contacted by the nutating bit, the bit in effect rolling around on the work material at the cyclic vibration frequency. Further, there is a high force, short stroke motion of the bit which matches the high impedance characteristics of hard material such as rock. It is also to be noted that the various drill bit portions successively impact against the work material and then are released therefrom in a smooth sinusoidal vibration by virtue of the nutating action so that each small portion of the bit is only in contact with the work material during a short portion of the total operation cycle. This lessens wear on the bit and tends to avoid overheating and fracturing thereof when working against particularly hard material.

In achieving the desired nutating drilling action, the device of the invention employs an elastic drill stem which at the bottom end thereof is connected to a drill bit which is in biased engagement with the work material, and towards the top end thereof is connected an orbiting mass oscillator. The oscillator and drill stem are surrounded by a jacket member which permits a limited degree of lateral freedom of movement for the drill stem and the oscillator. The oscillator has an eccentric rotor which when rotatably driven generates a vibration force having a rotating force vector about an axis substantially parallel to the longitudinal axis of the stem member. This rotating force vector causes the stem to cyclically elastically stretch and compress longitudinally in continuously successive circumferential regions with the stem describing a closed orbital motion. This elastic orbital motion causes the bit to nutate or roll about the work material, the bit being constrained against the work material in a pivotal manner by virtue of the vertical bias force applied thereto by the weight of the drilling assembly.

In a preferred embodiment of the invention, the stem is driven at a resonant frequency thereof so as to set up a standing wave pattern therein with the oscillator and the column being free while the drill bit is constrained against the work material such that the stem resonates with cyclically successive longitudinal stretching and compressing around the length thereof in a wave pattern having an odd number of quarter wavelengths and the drill bit is caused to cyclically nutate or roll around the work material. For optimum power delivery to the elastic stem, the oscillator should be located either at the free end thereof or at some other antinode of the standing wave pattern.

In view of the fact that the force vector of the oscillator is generally normal to the longitudinal axis thereof and the longitudinal axis of the stem, a simple high force output oscillator having very moderate bearing load can be employed. Thus, an oscillator which is rather elongated, such as a "moyno" screw-type rotor which is driven by a mudstream, can be employed.

It is therefore an object of this invention to provide an improved vibratory drill particularly suitable for drilling through hard material such as rock, masonry and concrete.

It is a further object of this invention to provide an improved drill employing a sonic elastic drill stem which is surrounded by a jacket providing limited freedom of lateral movement and which drives a drill bit against the work material in a cyclic nutating fashion.

It is still a further object of this invention to provide an improved drill suitable for drilling hard material in which successive portions of the drill bit are progressively impacted against the work material with rest periods in between, thereby minimizing wear on the bit and lessening the likelihood of its fracture.

Other objects of the invention will become apparent as the description proceeds in connection with the accompany drawings of which:

Figure 1A:
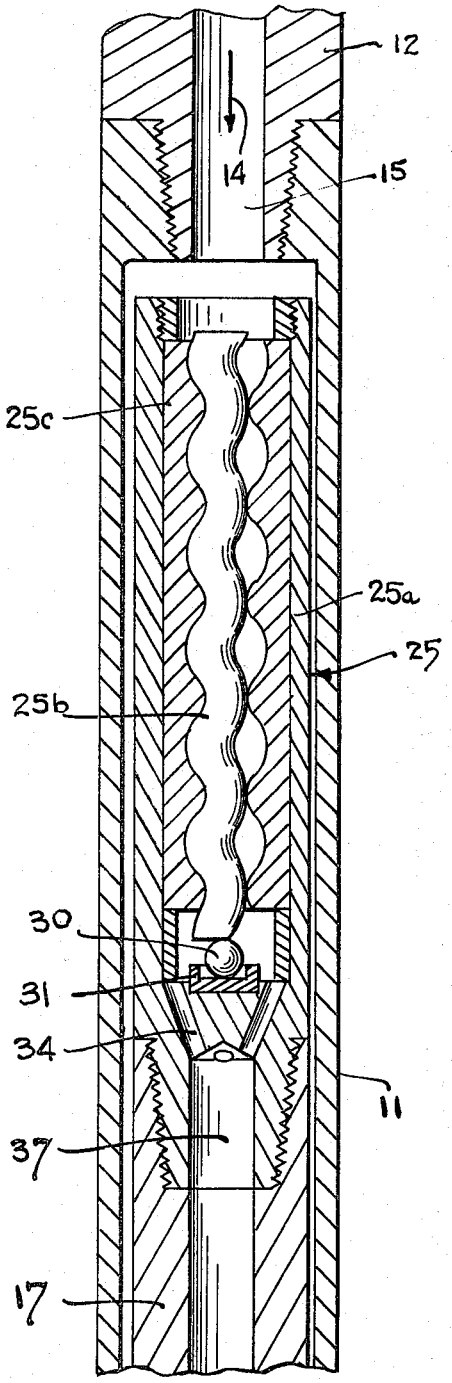
FIGS. 1A and 1B are elevational views in cross section of a first embodiment of the invention.

It has been found most helpful in analyzing the device of this invention to analogize the acoustically vibrating circuit utilized to an equivalent electrical circuit. This sort of approach to analysis is well known to those skilled in the art and is described, for example, in Chapter 2 of "sonics" by Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance $C_e$, mass M is equated with electrical inductance L, mechanical resistance (friction) $R_m$ is equated with electrical resistance R and mechanical impedance $Z_m$ is equated with electrical impedance $Z_e$.

Thus, it can be shown that if a member is elastically vibrated by means of an acoustical sinusoidal force $F_0 \sin \omega t$ ($\omega$ being equal to 2 times the frequency of vibration), $$Z_m = R_m + j\left(\omega M \frac{1}{\omega C_m}\right) = \frac{F_0 \sin \omega t}{u} \quad (1)$$

Where $\omega M$ is equal to $1/C_m$, a resonant condition exists, and the effective mechanical impedance $Z_m$ is equal to the mechanical resistance $R_m$, the reactive impedance components $\omega M$ and $1/\omega C_m$ cancelling each other out. Under such a resonant condition, velocity of vibration u is at a maximum, power factor is unity, and energy is more efficiently delivered to a load to which the resonant system may be coupled.

It is important to note the significance of the attainment of high acoustical "Q" in the resonant system being driven, to increase the efficiency of the vibration thereof and to provide a maximum amount of power. As for an equivalent electrical circuit, the "Q" of an acoustically vibrating circuit is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating circuit can be maximized to make for highly efficient, high-amplitude vibration by minimizing the effect of dissipation in the circuit and/or maximizing the effect of mass in such circuit.

In considering the significance of the parameters described in connection with equation (1), it should be kept in mind that the total effective resistance, mass and compliance in the acoustically vibrating circuit are represented in the equation and that these parameters may be distributed throughout the system rather than being lumped in any one component or portion thereof.

It is also to be noted that orbiting mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristic of Applicant's unique orbiting mass oscillators. Furthermore, in this connection the orbiting mass oscillator automatically changes not only its frequency but is phase angle and therefore its power factor with changes in the resistive impedance load, to assure optimum efficiency of operation at all times. The vibrational output from such orbiting mass oscillators also tends to be constrained by the resonator to be generated along a controlled predetermined coherent path to provide maximum output along a desired axis.

Figure 1B:
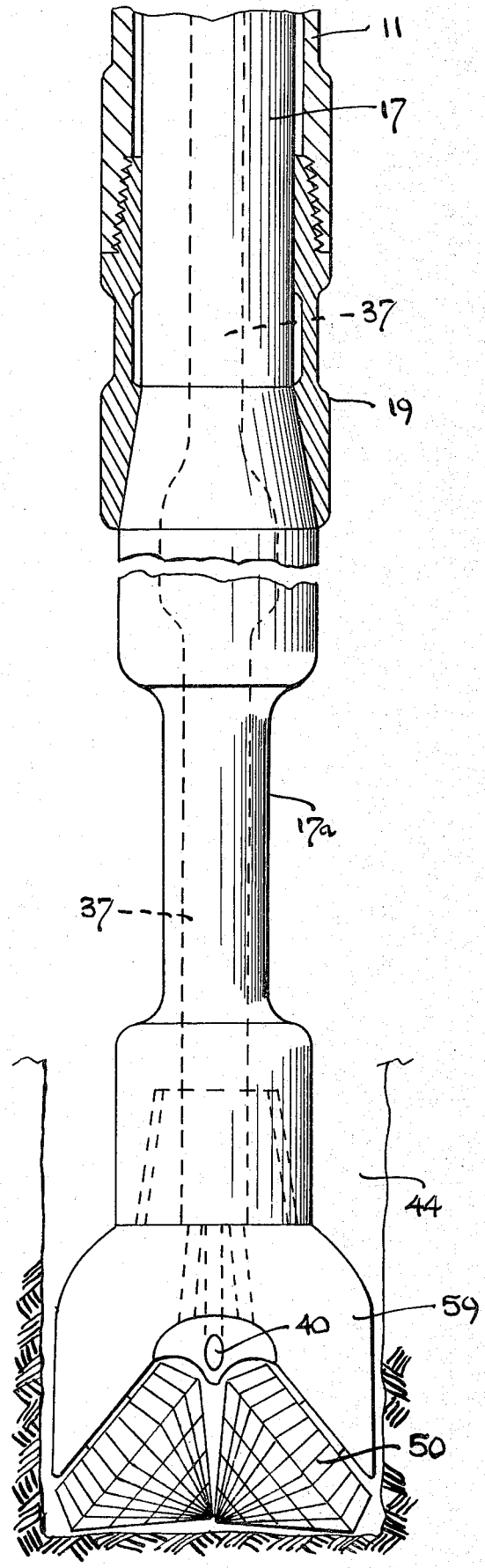

Referring now to FIGS. 1A and 1B, a first embodiment of the invention is illustrated. Jacket member 11 is fixedly attached to drill collar 12, which is suspended from a conventional drilling rig (not shown). The drill collar is tightly coupled to the jacket so as to provide a tight seal for the mudstream which flows as indicated by arrow 14 through channel 15 formed in the drill collar. Supported within jacket 11 is drill stem 17 which is fabricated of an elastic material such as steel, and in this particular embodiment is a relatively long, heavy member, the elastic displacement of which is not as great as in certain of the other embodiments. Drill stem 17 is held in jacket 11 by means of clamp member 19 which is placed near a node of the standing wave vibration pattern set up in the stem as to be explained further on in the specification. Drill collar 12 is a relatively heavy member which is substantially heavier than jacket 11, such that it does not tend to accept a substantial amount of any vibratory energy which may appear in the jacket. Mounted within jacket 11 in spaced relationship therefrom and fixedly attached to stem 17 is orbiting mass oscillator 25. The casing **25*a* of this oscillator is spaced from the jacket to permit the oscillator to displace laterally within the jacket when the stem 17 stretches longitudinally in rotary progression around its perifery. In this particular embodiment, this spacing is rather small, the lateral excursions of the oscillator casing and the stem being limited by the jacket, thereby avoiding overstressing of stem 17. Oscillator 25 has a screw-shaped rotor 25*b* which rolls around the inner surface of mating screw-shaped stator elements 25*c*. This orbital rolling of the rotor 25*b* is the source of the desired vibratory or rotating force vector. A thrust bearing for the bottom of rotor 25*b* is provided by ball 30 which is supported and constrained laterally loosely for rolling within a holder 31. Rotor 25*b* is rotatably driven by means of a mudstream (indicated by arrow 14) which is fed into channel 15 of the drill collar. The mudstream is fed out from the bottom of the oscillator through slots 34 and thence through channel 37 formed in the stem. The mudstream is exited from channel 37 through nozzle 40 at the drilling bit and from this nozzle passes into the drill bore 44. The rotor and stator of oscillator 25 are of the type conventionally used in moyno motors, the rotor in conventional application being used to drive a driveshaft by the twisting component of 25*b*. In this instance, however, the orbiting path of the rotor between the screw-shaped stator generates the uniquely employed vibratory energy in casing 25*a* at the frequency of the rolling progression thereof. Roller cones 50 of the bit 59 are connected to the bottom of the drill stem for effecting the nutating drilling action in response to the vibratory energy developed in the oscillator. Bits with roller cones 50 may be of the type commerically available from Hughes Tool Company, Reed Tool Company or Smith Tool Company. A short slender section 17***a* may be provided in the elastic stem to increase the angle of bit nutation in response to the vibratory action. As to be explained more fully in connection with FIGS. 5A–5E, the frequency of oscillator 25 is adjusted to produce standing wave elastic vibration of the stem with the longitudinal stretching of the column of this invention. In view of the fact that the bit members 50 are biased against the work material by the weight of the drill string, a pivotal node of the vibration pattern is formed at the bit with the drill stem stretching and compressing longitudinally in continuously successive longitudinal vibration, within the constraints provided by the jacket, progressively around the stem. The drill bit thus nutates or rocks around on the work piece, because of said progressive longitudinal vibration around said stem, with various portions of the bit successively impacting against the work material (as illustrated in FIGS. 5A–5E). Although the screw-type rotor has advantages in view of its simplicity, economy of construction and reliable operation, other individual types of oscillator rotors, such as those described in my U.S. Pat. Nos. 4,023,628 and 4,096,762, may also be employed where application requirements may permit. Although the total drilling may be accomplished by the vibratory energy, the drill string may also be rotated from above in conventional fashion to simultaneously provide normal type of drilling in combination with the vibratory drilling just described.

Figure 2A:
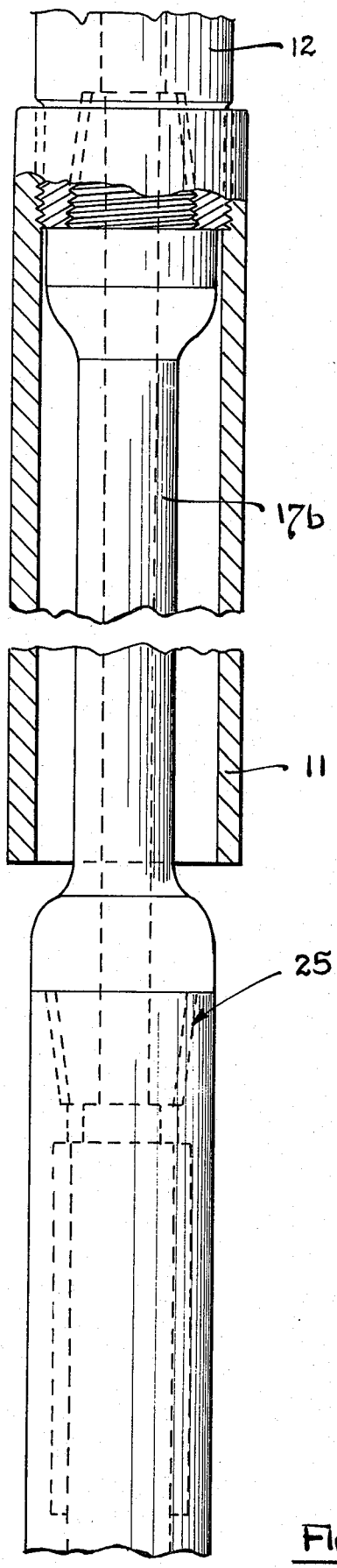
FIGS. 2A and 2B are elevational views, partially in cross section, of a modified version of the first embodiment.
Figure 2B:
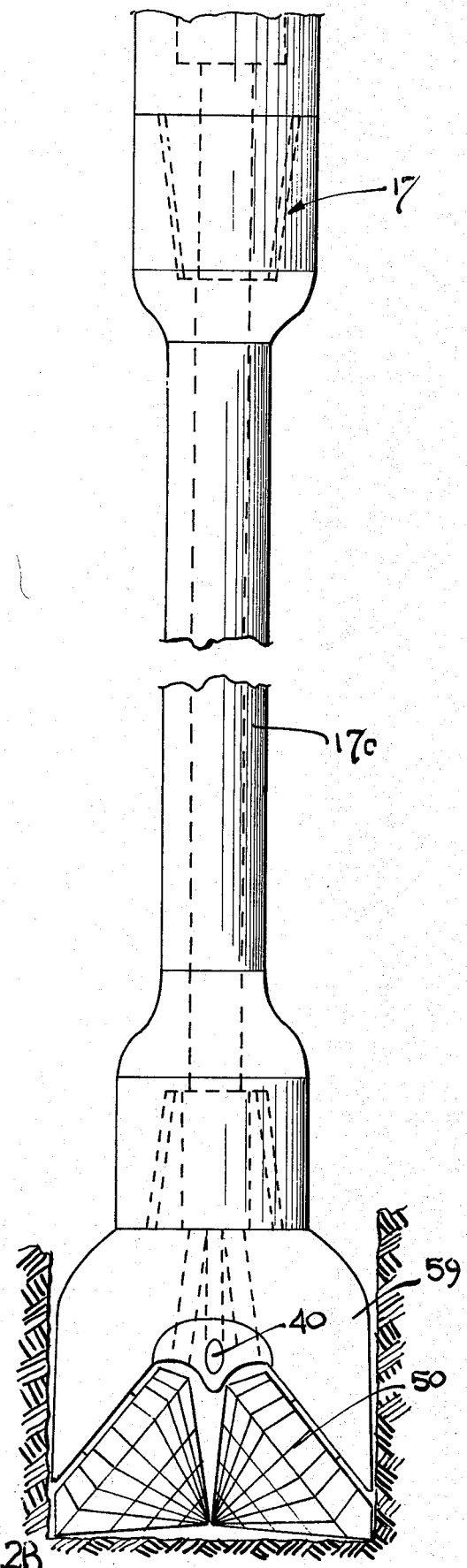

Referring now to FIGS. 2A and 2B, a second embodiment of the invention is illustrated. In this second embodiment, the oscillator is interposed between a first drill stem section 17*b* and a second drill stem section 17*c*, both of these drill stem sections being relatively slender and highly flexible. Drill stem section 17*b* is surrounded by jacket 11. The jacket does not necessarily extend over the oscillator 25 or lower stem section 17*c*. Lower stem section 17*c* is connected to the drill bit and cones 50. Slender drill stem section 17*b* effectively limits the transmission of vibratory energy into drill collar 12 which is connected thereto, the collar being relatively heavy and not responding to the relatively light section of drill stem 17*b*. The inertial effect of the drill collar is further augmented by the downwardly depending inertial jacket 11 which surrounds drill stem section 17*b*. The spacing between jacket 11 and drill stem section 17*b* is substantially greater than that for the first embodiment, such that more bending or lateral displacement for a given longitudinal elastic vibratory stress in the stem is permitted than in the first embodiment. The relatively slender lower drill stem section 17*c* provides greater elasticity for the vibratory motion transmitted to the bit such that the bit has greater vibratory rocking or nutating motion than in the first embodiment. The embodiment of FIG. 1 operates more efficiently in very hard rock with high acoustic impedance where the vibration of the bit should have high force relative to stroke, while the embodiment of FIG. 2 is better for softer formations that respond to larger bit stroke amplitude. It is to be noted that in the embodiment of FIG. 2 the oscillator is located between an upper and a lower stem section such that portions of the standing wave vibratory pattern will appear above and below the oscillator.

Figure 7:
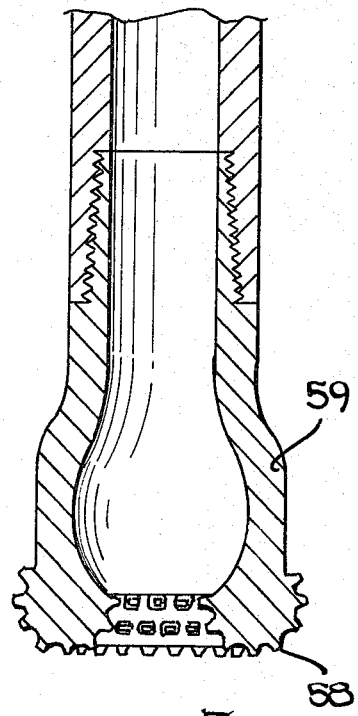
FIG. 7 is a cross-sectional view of still another drilling bit that may be used in the invention.
Figure 8:
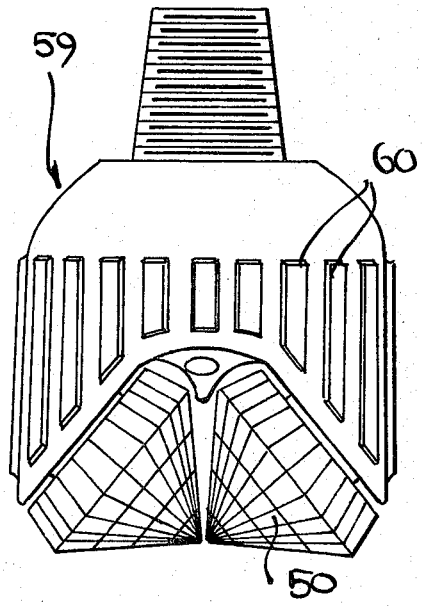
FIG. 8 is an elevational view of a modified form of the preferred embodiment of the bit assembly which may be employed in the device of the invention.
Figure 4A:
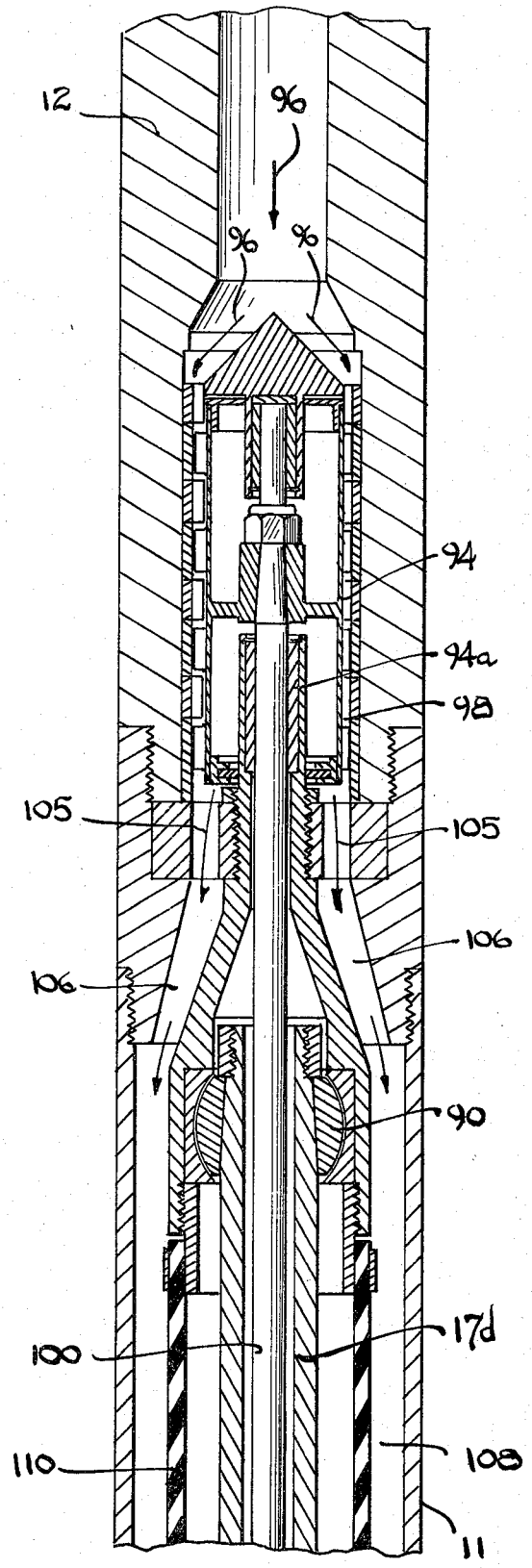
FIGS. 4A–4D are elevational views, in cross section, of a third embodiment of the invention.
Figure 4B:
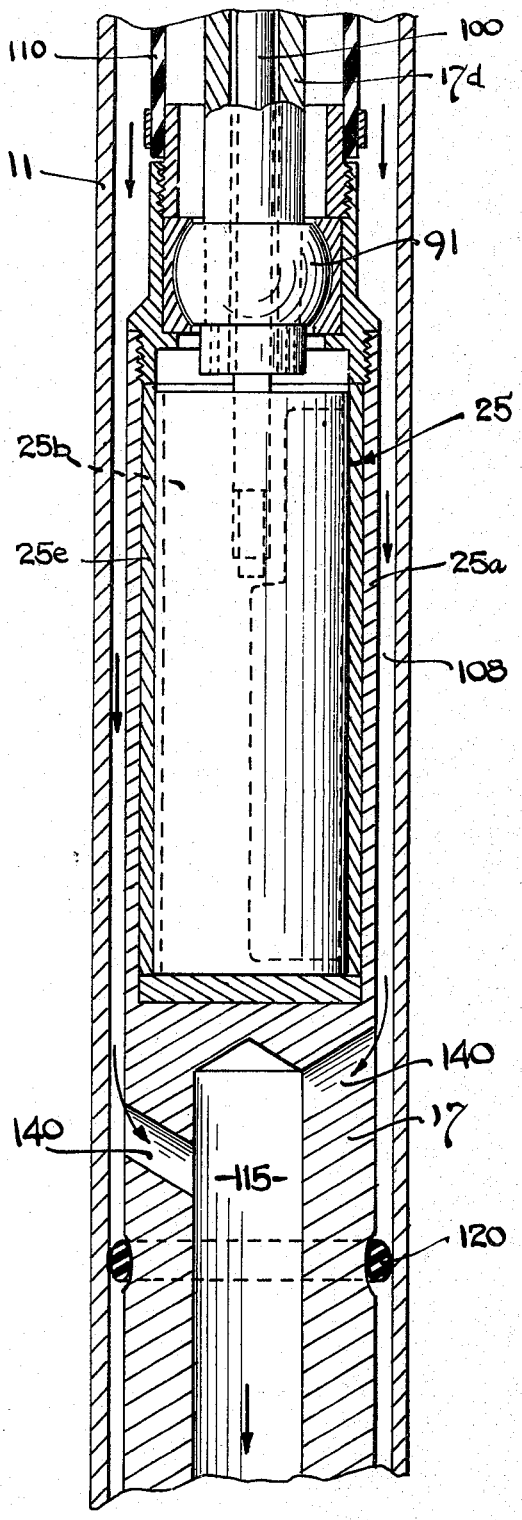
Figure 4C:
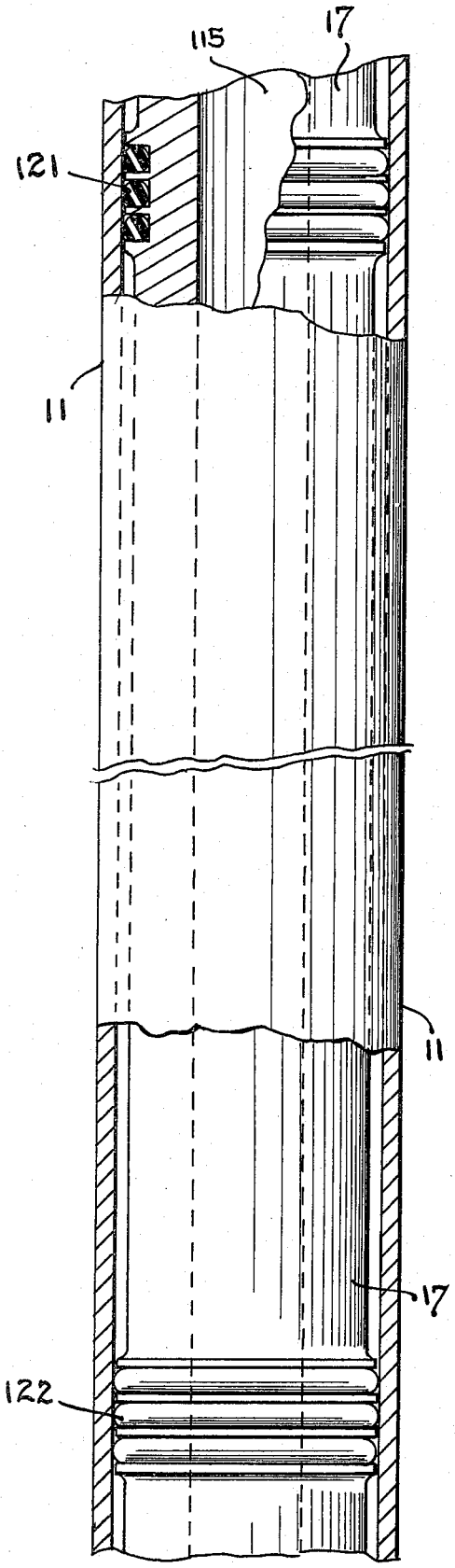
Figure 4D:
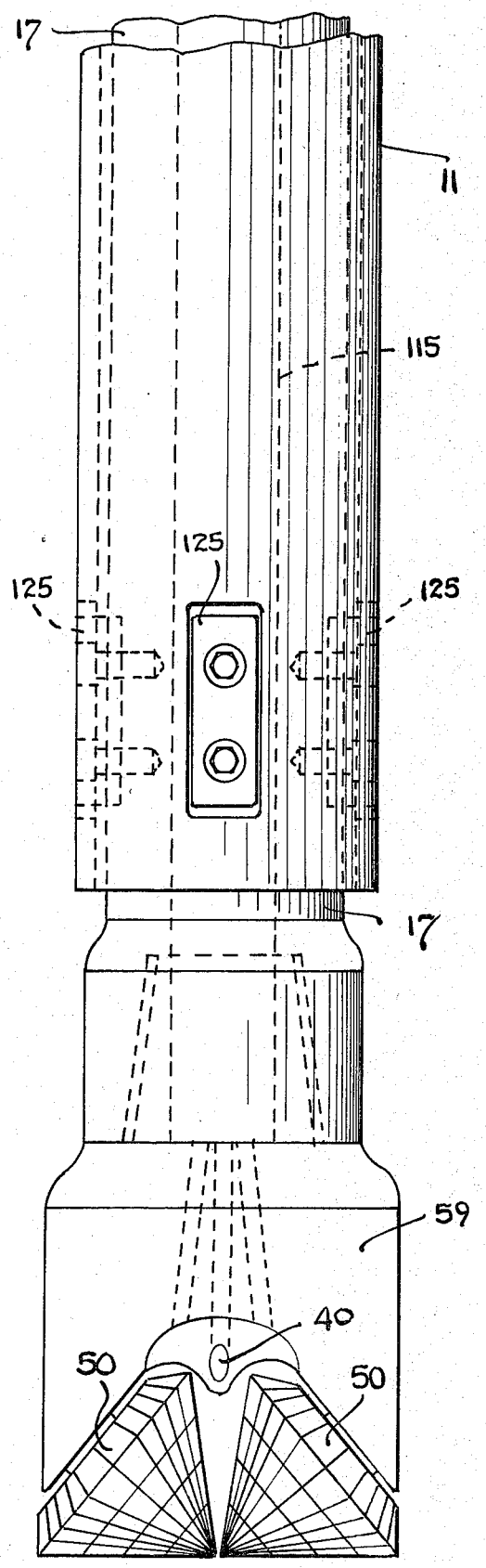
Figure 6:
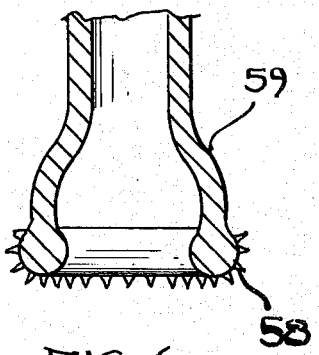
FIG. 6 is a cross-sectional view of an alternate bit member which can be used in the device of the invention.

FIGS. 6–8 show various further types of drilling bit devices. FIGS. 6 and 7 show a form of bit 59 which is a core tube cutter, the lower rim 58 of which drills by the vibratory nutating action of rolling around on its kerf. FIG. 8 shows a bit assembly 59 having ridges 60 which aid the bit's action as a cycloidal rotary drive source.

Figure 3:
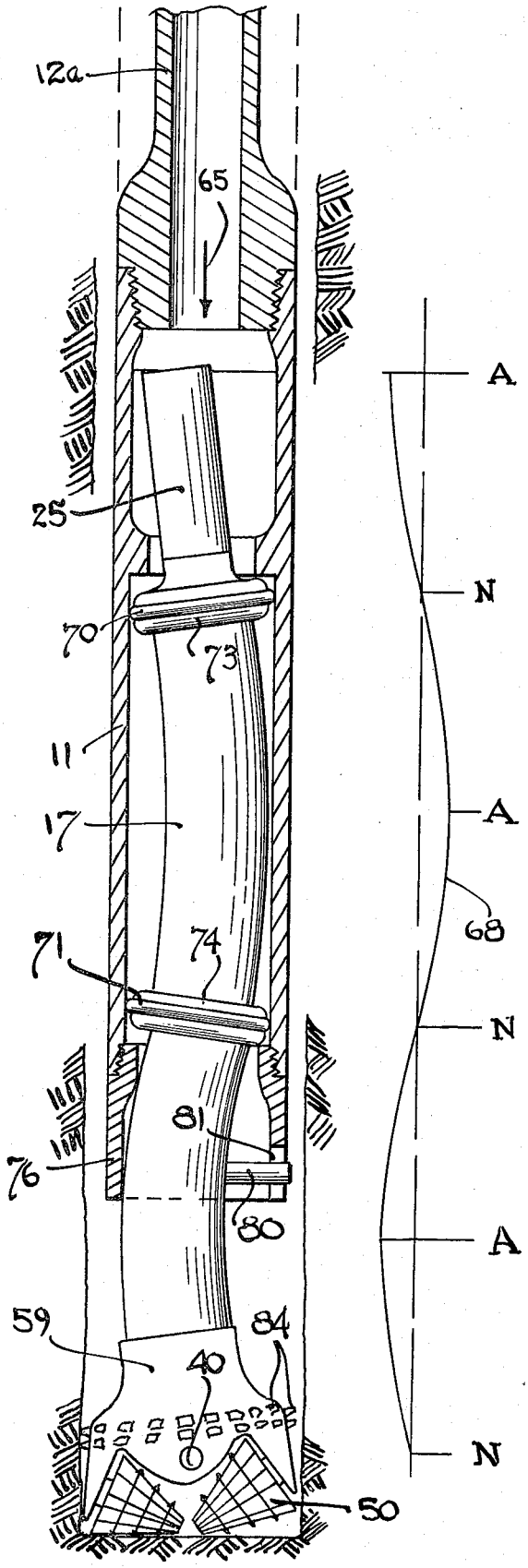
FIG. 3 is an elevational view, in partial cross section, of a second embodiment of the invention illustrating elastic standing wave vibration of the drilling stem.

Referring now to FIG. 3, a further embodiment of the invention is illustrated. The device of the invention is shown in operation so as to dynamically illustrate the resultant bending of the stem caused by the circumferential progression of longitudinal elastic vibration with the vibratory standing wave pattern developed therein. Oscillator 25 may be the same type of oscillator as used in the embodiment of FIG. 1, or may be a turbine-driven oscillator such as described in my U.S. Pat. No. 4,096,762. The oscillator is driven by a mudstream fed thereto from drill pipe 12 as indicated by arrow 65 with the mudstream passing through the oscillator to provide the rotational drive thereof and thence through stem 17 from which it is exited at bit nozzle 40, as in the previous embodiments. The oscillator and most of the stem are contained within jacket 11 which permits and limits the resultant bending of the stem, as indicated in the figure, in response to the longitudinal vibratory stress successively induced around the body thereof from oscillator 25. The degree of bending of stem 17 has been exaggerated for ease of illustration and normally would not be as great as illustrated in the figure. As in the previous embodiments, the cyclic vibratory energy from stem 17 is transferred to bit cones 50 and induces a nutating rolling action thereof on the work material. A standing wave pattern is set up in the drill stem and oscillator housing, as indicated by graph line 68, with the node of the pattern being indicated by "N" and the antinodes of the standing wave pattern being indicated by "A". Upper and lower O-rings 70 and 71 are mounted in flanges 73 and 74 which are fixedly attached to the stem. Annular space is thus provided between the flanges for oil within jacket 11 to lubricate and extend the life of the O-rings. The flanges and O-rings abut against the inside wall of the jacket 11 and serve to keep the stem centered and aligned so that the bit drills a straight hole. Assembly collar 76 is threadably attached to the bottom of jacket 11. Pin member 80 on stem 17 may be registered freely within a notch 81 provided in the wall of collar 76 and fixedly supported in stem 17. This facilitates the transmission of rotary torque from drill pipe 12*a* via jacket 11 and stem 17 to bit 59 while permitting flanges 73 and 74 to be freely fitted in the jacket. In certain instances, the pin and notch may be dispensed with, with rotation of the bit being accomplished by the cycloidal action of the side walls of the bit body 59 against the bore hole by virtue of gauge cutting and cycloidal traction teeth 84 formed therein. Flanges 73 and 74 are located near the nodes, "N", of the standing wave vibratory pattern, there being a 5/4 wave pattern provided by virtue of an appropriate choice of frequency for the particular oscillator stem and bit assembly employed.

Figure 11:
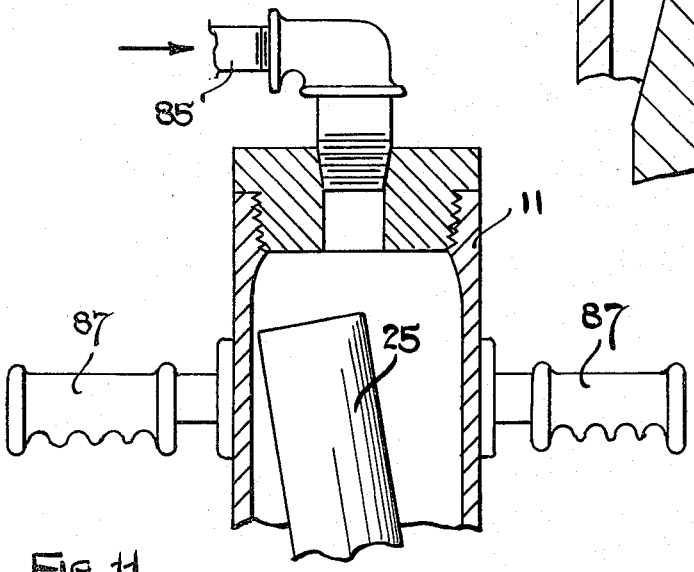
FIG. 11 is a cross-sectional view in elevation illustrating a pneumatic drive which may be employed to drive the oscillator of the invention.

The device of the invention can be scaled down and adapted for use in a pneumatic drill, as shown in FIG. 11. In this embodiment, the construction is basically the same as that of FIG. 3 except that the oscillator is a conventional gas motor or turbine drive oscillator rather than a mud-driven oscillator, the turbine being driven by a pneumatic stream supplied to jacket 11 from pneumatic line 85, and with hand grips 87 being attached to the jacket.

Figure 9:
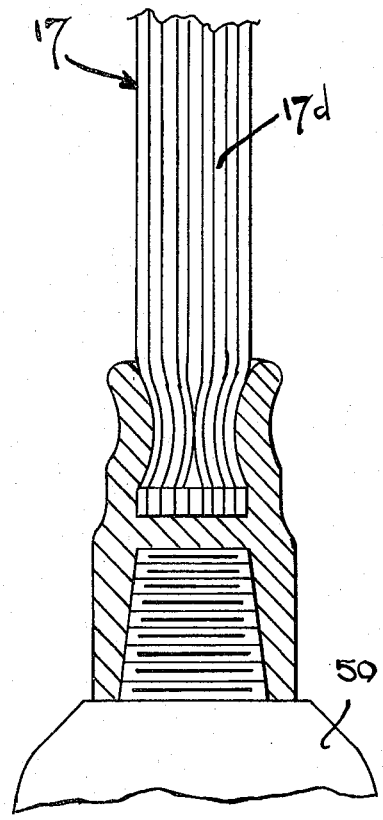
FIG. 9 is a cross-sectional view in elevation illustrating an alternate form of a stem member which may be employed in the device of the invention.

Referring to FIG. 9, an alternative form for stem 17 is illustrated, this stem being in the form of a bundle of rod members 17*d* which are swedged together at their base attachement to the bit assembly and which form an effectively slender column. The rods normally would be made from spring material so as to provide increased amplitude and effect of longitudinal elastic vibration for a given vibrational input thereto from the oscillator.

Figure 10:
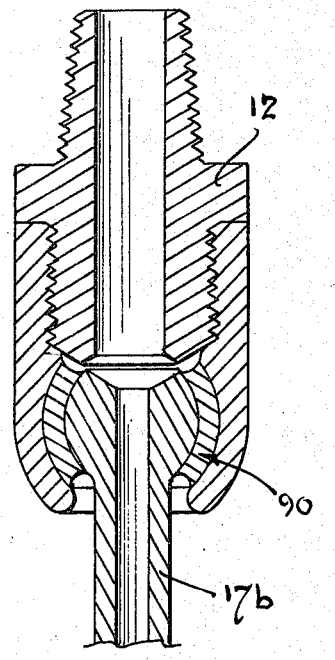
FIG. 10 is a cross-sectional view in elevation of a ball joint which may be used as an isolater section which may be employed between the drilling stem and collar member of the device of the invention.

Referring now to FIG. 10, a ball and socket joint 90 is shown for use as an isolator means between the coupling 12 and the stem 17. Such ball and socket joints could be used, for example, in the embodiment of FIG. 2 between the upper end of stem section 17*b* on the drill collar and the lower end of this stem section 17*b* and the oscillator 25, permitting this stem section 17*b* to be substantially shorter in length, thereby facilitating its transportation, etc.

Referring now to FIGS. 4A–4D, a preferred embodiment of my invention is illustrated. Drill collar 12 has a turbine rotor 94 and associated parts mounted therein, this rotor being rotatably driven by a mudstream indicated by arrows 96 which is fed to the center of the collar. This turbine may be of the type described in my U.S. Pat. No. 3,096,833. The turbine rotates on a sleeve bearing 94*a* and includes a centrigual trap device 98 which prevents solid particles, such as sand, from reaching bearings and ball joints and effectively cleans such particles from separated water which is fed along drive shaft 100. This trap is of the type described in my U.S. Pat. No. 4,091,988. The mud is fed out of the turbine and, as indicated by arrows 105, into the ports 106 below the turbine and thence to annular channel 108 which connects to passage 115 through ports 140 shown in FIG. 4B and FIG. 12. Passage 115 runs all the way down the drill stem 17 to bit 59 where nozzle 40 is provided for releasing the mud into the drill bore. A thrust tube 17*d* is joined to the collar 12 at its upper end by means of a ball and socket joint 90 (as shown in FIG. 10) and, at its lower end, to the housing of oscillator 25 by a similar such ball and socket joint 91. As described earlier in the specification, the use of a thrust tube 17*d* which is joined to the drill collar by ball and socket joints provides effective vibration isolation between the vibrating system and the collar. Jacket member 11 is attached to drill collar 12 and contains the drill stem and the oscillator, as in the previous embodiments. This jacket, as in the previous embodiments, limits the amplitude of vibration of the drill stem and helps isolate the drill collar from this vibration. A rubber hose boot 110 is placed between thrust tube 17*d* and jacket 11 to isolate the mudstream flowing in channel 108 from the fluids in the central portions of the drill. Drive shaft 100 couples the rotary output of tubine 94 to orbiting mass oscillator 25, this oscillator having an unbalanced rotor 25*b*, unbalanced as shown by dotted lines, which is mounted for rotation within casing 25*a*. Casing 25*a* is formed integrally with stem member 17. The rotor 25*b* is supported in casing or housing 25*a* on water lubricated bearings 25*e*. Rotor 25*b* is a single rotor which may be of the type for each of the paired rotors described in my U.S. Pat. No. 4,096,762. Below oscillator 25, the mudstream is fed from channel 108 via ports 140 to a central channel 115 formed in the drill stem 17. An O-ring 120, or glands 121 and 122, is provided between stem 17 and jacket 11 to divert mud out of this region and to centralize the stem 17 and preferably are placed in nodal regions of the standing wave vibration pattern. Torque lugs 125 may be used to retain the drill stem 17 within jacket 11, and to deliver rotary motion of conventional type to bit 59 from drill pipe 12*d* via jacket 11 and stem 17.

In operation, as for previous embodiments, oscillator 25 is driven at a speed such as to set up resonant standing wave vibration of drill stem 17 with longitudinal stressing of the stem resulting in the described progressive longitudinal vibration which is transferred to the bit cones 50 so as to effect nutation thereof.

Figure 12:
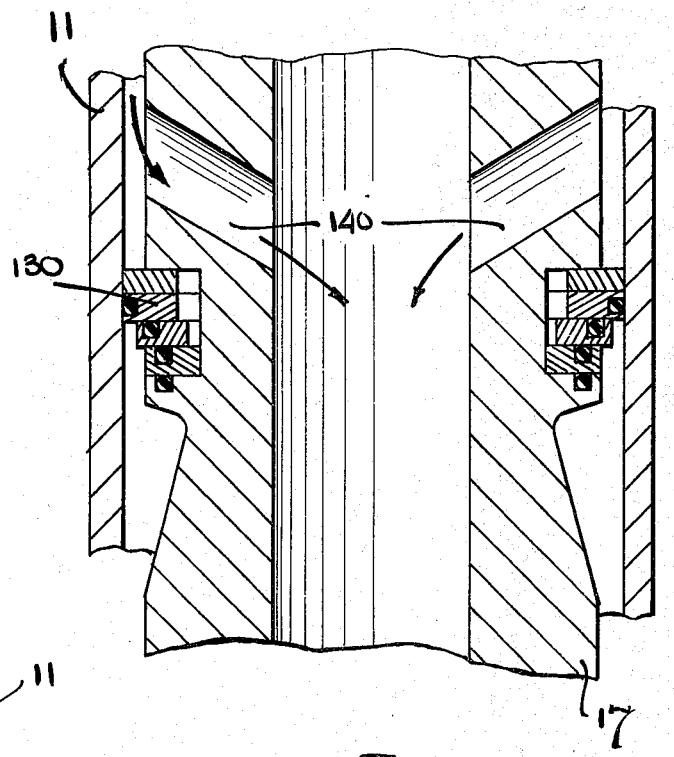
FIG. 12 is a cross-sectional view in elevation employing a piston ring type of pressure gland in channeling the mud to the drill stem beneath the oscillator.

Referring now to FIG. 12, the use of a piston-ring type of pressure gland 130 between the jacket 11 and the stem 17 in lieu of the O-ring 120 and glands 121 and 122 of the embodiment of FIGS. 4A–4D and the flanges 73 and 74 and associated O-rings of the embodiment of FIG. 3 is shown. The piston ring type pressure gland 130 is located below the ports 140 through which the mudstream flows from annulus 108 into the channel 115 in the center of the drill stem 17. This piston ring type pressure gland effectively provides a seal between the inner wall of jacket 11 and the outer wall of drill stem 17, thereby preventing mud flow therebetween below said gland. In view of the fact that this type of piston ring type of gland accommodates lateral motion because the faces of the rings can slide across each other, the gland does not have to be located at a node of the standing wave vibration pattern. This can be significant because the material being drilled can change in its acoustic impedance characteristics with drilling so as to shift the node locations.

Figure 5A:
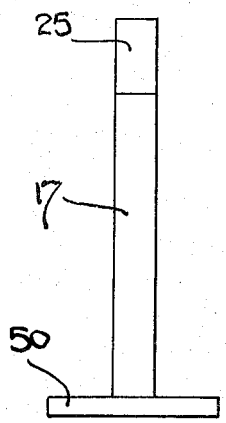
FIGS. 5A–5E are a series of schematic drawings illustrating the operation of the invention.
Figure 5B:
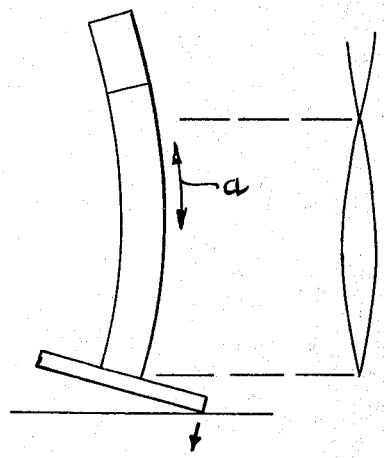
Figure 5C:
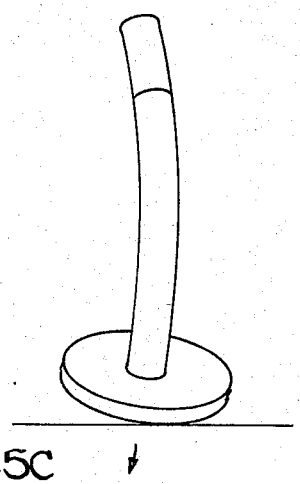
Figure 5D:
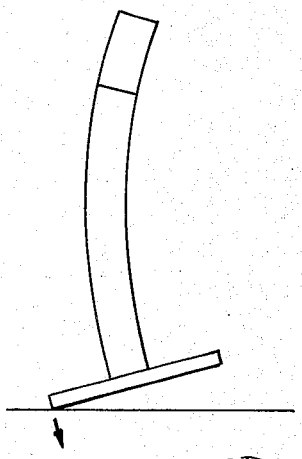
Figure 5E:
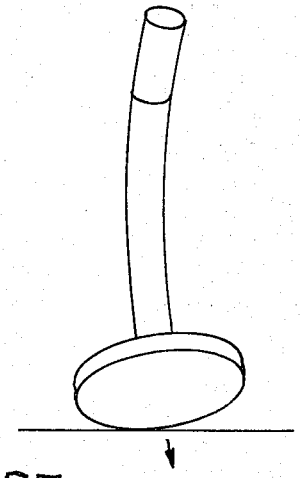

Referring now to FIGS. 5A–5E, the operation of the system of the invention is illustrated by a series of animated sketches. FIG. 5A illustrates the system at rest, oscillator 25, stem 17 and drill bit 50 being shown in their relative positions. The drill bit is shown in the form of a disc for convenience of illustration. The rotary force vector of the oscillator turns in a plane normal to stem 17 causing the column to form an elastically displaced arch with longitudinal stretching along the outer lengthwise curve as illustrated by the double arrow a in FIG. 5B. This longitudinally stretched portion of the column causes the right-hand portion of the bit to press downward against the work material as shown in FIG. 5B. As the longitudinal stretching of stem 17 quickly progresses around stem 17 in response to said rotary force vector of oscillator 25 (here turning clockwise looking down), the bit is simultaneously rolled forward as seen in FIG. 5C which is about 90° in the cyclical vibration pattern from the position shown in FIG. 5B, and the further circumferential progression of stretching continues the bit continues to roll and, as shown in FIG. 5D, is in a cyclical position approximately 180° from that of FIG. 5B. FIG. 5E shows the bit in a rotational position approximately 90° after that of FIG. 5D and 270° from that of 5B. Thus, as can be seen, the bit rotates or nutates about against the work material in a cylical manner with various portions of the bit successively impacting against the work material, this in response to the longitudinal elastic vibration of circumferentially successive lengthwise segments of the column.

The elastically vibrating column of this invention provides a superior technique for effecting drilling by longitudinal vibration of the bit. In very hard rocks, for example, the elastic bar functions as an impedance matching device where the oscillator moves with much greater motion than the bit, and hence the bit delivers very large cyclic longitudinal force to the rock. Moreover, this leverage effect comes about as a matter of location of wave pattern nodes along the elastically vibrating bar, and these nodes will shift automatically as the impedance of the rock changes. The harder the rock, the more impedance to motion of the bit, and consequently the node moves closer to the bit and the force cycle stress in the rock increases. The elastic system of this invention also has good energy storage or acoustic "Q" and as a result there is a reservoir of dynamic force to draw upon when a bit tooth encounters a particularly hard spot.

As already noted, the system of the invention may be used by itself in effecting the drilling action, or may be used in combination with normal rotary drilling, the entire drill string being rotated at a relatively slow speed as compared with the vibrational nutation of the bit in response to the energy generated by the oscillator. Moreover, if torque pin 80 at lugs 125 are not used, there is a cycloidal rotary force on the bit causing it to turn in response to the sidewall cycloidal effect of said pivotal restraint of said bit in this invention.

While this invention has been described and illustrated in detail, it is to be clearly understood that this is intended by way of illustration and example only and is not to be taken by way of limitation, the spirit and scope of this invention being limited only by the terms of the following claims.

I claim:

1. A sonic drill suitable for drilling through hard work material comprising:

an elastic drill stem, a drill bit connected to one end of said drill stem, said bit being biased against said work material, an orbiting mass oscillator having an eccentrically mounted rotor and connected to said stem at a point therealong spaced from said bit, the rotation axis of said rotor being substantially parallel to the longitudinal axis of the stem, means for rotatably driving said oscillator rotor so as to generate a rotating force vector in said stem in a plane substantially normal to the longitudinal axis of the stem, said rotor being driven at a frequency such that an elastic standing wave vibration pattern is established in said stem, the stem being caused to cyclically stretch and compress longitudinally at the frequency of the vibration pattern so as to describe a closed orbital motion with orbital bending of the stem, the bit being nutated by the stem in rolling biased contact against the work material.

2. The drill of claim 1 wherein the oscillator operates at a resonant vibration frequency of said stem and is connected thereto at an antinode of the vibration pattern established therein.

3. The drill of claim 1 wherein said oscillator has a screw type rotor, the means for driving the rotor comprising a mudstream which is fed through said rotor.

4. The drill of claims 1, 2 or 3 and further including a jacket which surrounds said stem for at least a substantial portion of the length thereof and limits lateral movement thereof.

5. The drill of claim 1 wherein said bit is a roller cone bit.

6. The drill of claim 1 wherein said bit is a tubular shaped core cutting bit.

7. The drill of claim 1 wherein the oscillator is connected to the other end of the stem.

8. The drill of claim 1 and further including a column member above said stem and laterally flexible link means for interconnecting the column member and the stem.

9. The drill of claim 8 wherein said flexible link means comprises ball joint means.

10. The drill of claim 8 wherein said flexible link means comprises a thin flexible column member.

11. The drill of claim 1 wherein said stem is thinned down in the region of said bit so as to increase the flexibility thereof in this region.

12. The drill of claim 1 wherein the stem comprises a bundle of flexible rod members.

13. The drill of claim 1 wherein said stem includes upper and lower stem sections, said oscillator being interposed between said upper and lower sections.

14. The drill of claim 1 and further including a jacket which surrounds the stem for a substantial portion of the length thereof, a pin member extending from said stem, said jacket having a notch formed therein into which said pin member fits in engagement with the jacket thereby facilitating the transmission of rotary torque between the stem and the jacket.

15. The drill of claim 1 wherein the bit has gripping means formed on the side wall portions thereof for gripping the work material.

16. A method for drilling through hard work material comprising connecting a stem having elasticity along its longitudinal axis to a drill bit, applying a cyclical rotary force vector to said stem, said force vector lying in a plane substantially normal to the longitudinal axis of said stem, adjusting the frequency of said force vector to a frequency whereat an elastic vibration pattern is established in said stem, the stem being caused to cyclically stretch and compress longitudinally with orbital bending motion at the frequency of the vibration pattern and the bit being nutated thereby in rolling contact against the work material.

17. The method of claim 16 wherein the frequency of the force vector is adjusted to produce resonant standing wave vibration of the stem.

18. The method of claim 17 and further including the step of biasing the bit against the work material with sufficient force to effect a pivotal node of the vibration pattern of the bit with an odd number of quarter wave lengths being formed in the standing wave vibration pattern of the stem.

* * * * *